United States Patent [19]

Arnell et al.

[11] Patent Number: 4,745,862

[45] Date of Patent: May 24, 1988

[54] HOLDER FOR A MINE FUZE FOR AN ANTITANK MINE

[75] Inventors: Claes Arnell, Torshälla; Stig Risberg, Eskilstuna, both of Sweden

[73] Assignee: Affärsverket FFV, Eskilstuna, Sweden

[21] Appl. No.: 9,334

[22] PCT Filed: Apr. 14, 1986

[86] PCT No.: PCT/SE86/00171

§ 371 Date: Dec. 23, 1986

§ 102(e) Date: Dec. 23, 1986

[87] PCT Pub. No.: WO86/06469

PCT Pub. Date: Nov. 6, 1986

[30] Foreign Application Priority Data

Apr. 23, 1985 [SE] Sweden ..... 8501973

[51] Int. Cl.[4] ..... F42B 23/26; F42C 19/02

[52] U.S. Cl. ..... 102/424; 102/217; 102/275.4; 102/275.12

[58] Field of Search ..... 102/275.11, 275.12, 102/293, 416, 424, 428, 429, 401, 200, 204, 217, 275.4, 275.5, 275.6

[56] References Cited

U.S. PATENT DOCUMENTS 3,272,125 9/1966 Adams ..... 102/429 X 4,471,696 9/1984 Clayson ..... 102/200

*Primary Examiner*—Ted L. Parr

*Attorney, Agent, or Firm*—Fleit, Jacobson, Cohn & Price

[57] ABSTRACT

A holder is disclosed for a mine fuze for an antitank mine, in which the mine fuze incorporates a booster charge, a detonator for initiating the booster charge, and a spring-biased firing pin for initiating firing of the detonator. The holder is dimensioned to fit into a mine-fuze location provided in the antitank mine, where the booster charge is in fuzed relationship with the explosive charge contained by the mine. The holder is also provided with connectors for initiators for initiating one or more explosive charges located in the ground, the booster charge being in fuzed relationship with the initiators when the holder and mine fuze are attached.

3 Claims, 4 Drawing Sheets

HOLDER FOR A MINE FUZE FOR AN ANTITANK MINE

TECHNICAL FIELD

The present invention relates to a holder for a mine fuze for an antitank mine, the mine fuze incorporating a booster charge, a detonator for firing the booster charge, and a spring-biassed firing pin for firing the detonator.

BACKGROUND PRIOR ART

Known mine fuzes have a restricted use, due to the fact that they can only be used for certain types of mine in which the chamber or recess into which the fuze is fitted conforms with the external dimensions of the fuze. Neither can present day mine fuzes be readily primed to initiate firing of remotely situated explosive charges, e.g. in remotely located mines.

SUMMARY OF THE INVENTION

Consequently, it is the object of the present invention to provide a holder of the aforementioned kind which will enable the mine fuze to be primed in different kinds of mines incorporating mine-fuze recesses of mutually different size, and to enable the fuze to initiate firing of one or more remotely located explosive charges. These objects are achieved with the arrangement according to the invention having the characteristic features set forth in claim 1.

Further developments of the invention are set forth in the depending claims.

In accordance with the invention, the holder, which can be detachably connected to the mine fuze, it dimensioned to fit into a fuze-location, provided in the antitank mine, in which the booster is in firing relationship with the conventional high explosive charge of the mine, and is provided with connecting means for at least one initiating cord intended for initiating the firing of one or more explosive charges laid in the ground at a given distance from the mine fuze, the booster charge being in firing relationship with the initiating cord. This arrangement enables the holder to be dimensioned for any desired type of antitank mine, such that the mine fuze with the holder attached can be selectively primed in a desired fuze-location in the mine, or alternatively can be primed for use as a hidden booby trap for firing the aforesaid explosive charges located in the ground. These explosive charges are suitably placed behind the fuze, as seen in the direction in which an enemy force advances, so that the forward part of this force triggers the mine fuze, which subsequently fires the rearwardly lying explosive charges, via the initiating cords, i.e. beneath the rearwardly located part of the enemy force.

BRIEF DESCRIPTION OF THE DRAWINGS

The invention will now be described in more detail with references to the accompanying drawings, which illustrate a preferred embodiment of the invention.

DESCRIPTION OF A PREFERRED EMBODIMENT

Figure 1:
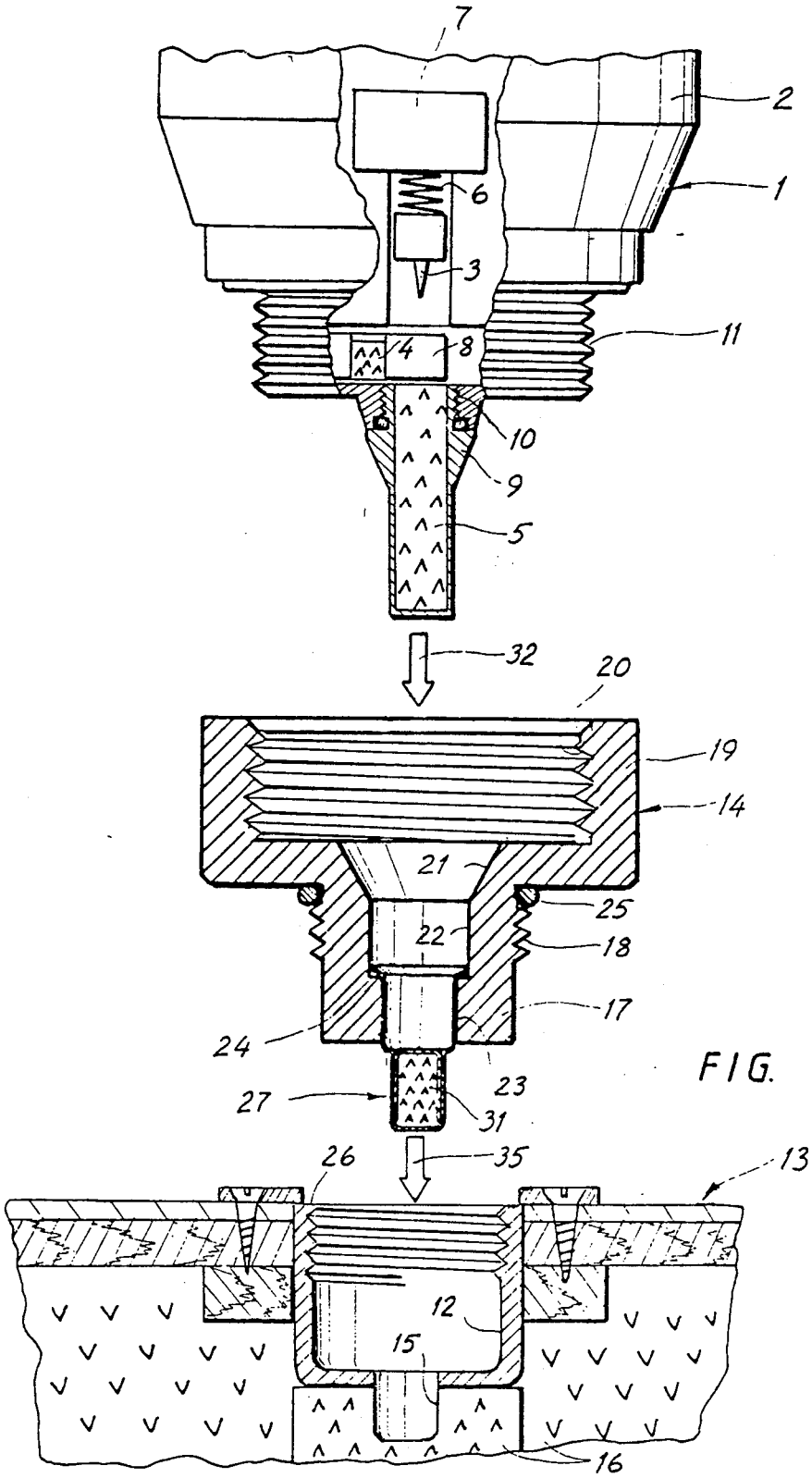
FIG. 1 is a central, partial longitudinal sectional view which illustrates how a mine fuze and a holder according to the invention can be primed in a mine.

In FIG. 1 there is shown a mine fuze 1 which includes a plastic or metal housing 2 and incorporates a schematically illustrated firing sequence, comprising a firing pin 3, a detonator 4, and a first booster charge 5. The firing pin is arranged to strike the detonator 4, through the agency of a firing spring 6, in response to the action of a pressure sensor 7 (not described in detail) which is arranged to release the firing pin 3 when sensing a predetermined load exerted by a tracked or wheeled vehicle passing over the sensor. In addition, the arrangement may include a known counterbalance adapted to fire the booster charge, via the firing pin, when the steady state of the mine is disturbed.

The detonator 4 is carried by a detonator holder 8 which can be moved in a manner now shown (for example with the aid of a clock mechanism not shown) from the illustrated safe position to an armed position, in which the detonator 4 is located in the aforesaid firing sequence, i.e. immediately beneath the firing pin 3.

All said components 1–8 may be of a generally known kind, and consequently need not be described in great detail here.

The booster 5 may have the form of a known cylindrical charge which is capable of being detonated by the detonator 4 and which is enclosed in a metal or plastic booster sleeve 9 provided with screwthreads 10 for screwing the sleeve to the housing 2.

Located on the fuze housing 2 is an external screwthread 11 which co-acts with a corresponding screwthread provided on the wall of a cylindrical recess (mine-fuze location) in a mine in a manner to secure the housing thereto, such that the booster 5 is able to detonate the explosive charge contained by the mine.

However, should the dimensions of the cylindrical recess, such as the recess 12 in the mine 13 illustrated in FIG. 1, be smaller than the dimensions of the screwthread 11 of the housing, the mine fuze 1 is held in a holder 14 in accordance with the invention. The holder 14 thus forms a connector between the fuze 1 and the recess 12 located in the mine.

The recess 12 located in the mine 13 is provided with a screwthread along approximately half of its depth or length, as seen from the entrance to the recess, and merges inwardly with a cylindrical recess 15 having a smaller diameter than the recess 12 and extending down into the location of a high explosive charge 16 in the mine 13.

The holder 14 is a cylindrical metal or plastic bar which has been machined along half of its length to provide a cylinder 17 of reduced diameter adjoining a non-reduced part of the holder 14. The cylinder 17 is provided along about half of its length, beginning from the non-reduced holder part, with a screwthread 18 which conforms with the screwthread in the recess 12.

The non-reduced part of the holder 14 forms a cylinder 19 having an axially screwthreaded bore 20 provided therein. The bore merges, via a conically tapering recess 21, with two cylindrical co-axial bores 22 and 23 in the cylinder 17, these bores being of mutually different, stepped diameter, to form an annular shoulder or step 24 at the juncture of the two bores 22 and 24. The bore 23 exits in the plane of the free end of the cylinder 17.

Arranged at the juncture between the cylinder 17 and the cylinder 19 is an O-ring 25 which sealingly abuts the annular edge 26 of the recess 12.

Figure 2:
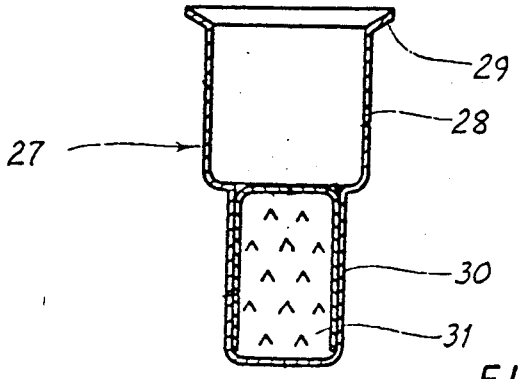
FIGS. 2 and 3 are central longitudinal views of two different types of a charge portion incorporated in the holder illustrated in FIG. 1.

The holder 14 carries a second booster 27, shown in enlarged scale in FIG. 2. The booster 27 comprises a cylindrical metal or plastic booster sleeve 28 which is open at one end, this open end of the sleeve 28 presenting a flanged or collared edge 29. The sleeve 28 transforms from a cylindrical external dimension, in the proximity of the flanged edge 29, which corresponds to the diameter and length of the bore 23, to a cylindrical sleeve portion 30 of reduced diameter. The sleeve portion 30 accommodates a second booster charge 31 intended for firing the high explosive charge 16 provided in the mine.

The booster 27 is inserted into the holder 14 through the bore 20 and is pressed down into the bore 23 until the edge 29 abuts the shoulder 24, as shown in FIG. 1.

Figure 4:
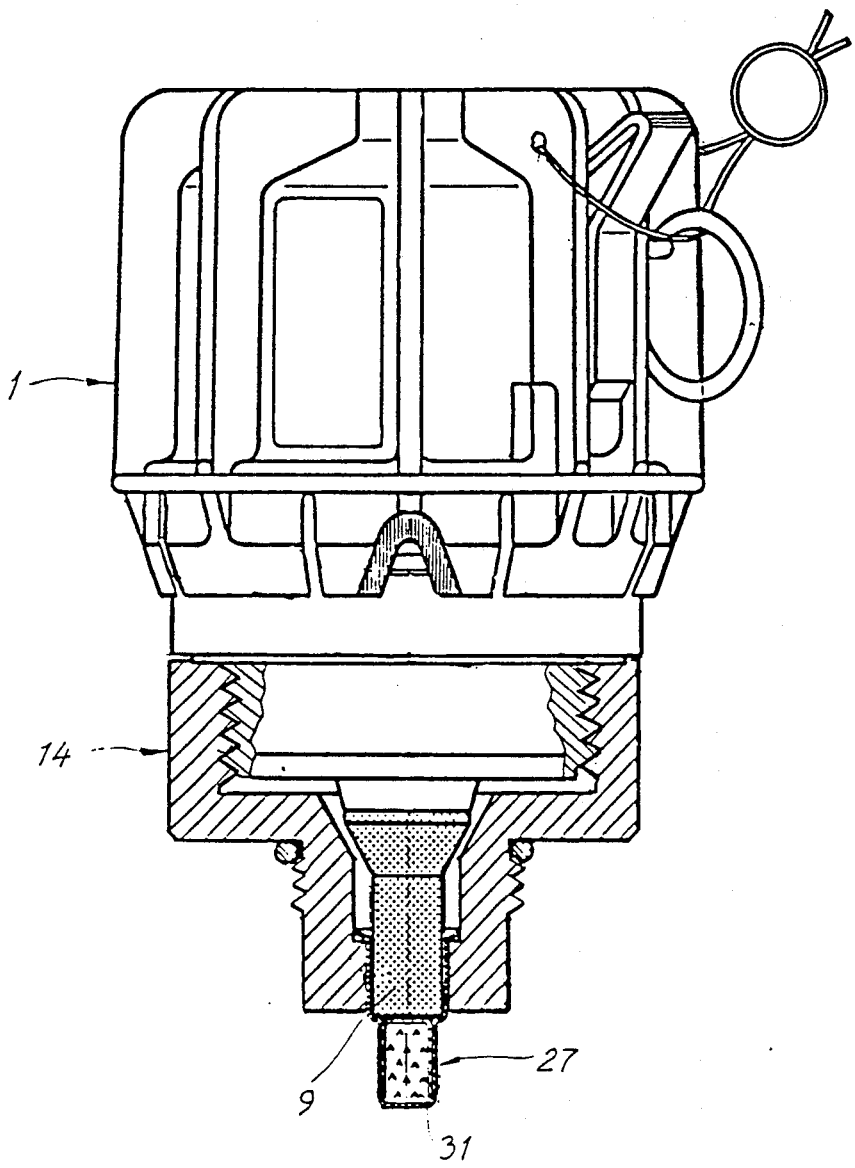
FIG. 4 is a side view, partly in central longitudinal section, illustrating how the mine fuze and the holder shown in FIG. 1 can be fitted together.

The fuze 1 can then be inserted into the holder 14 in the direction of arrow 32, therewith enabling the screwthreaded portion 11 to be screwed into the screwthreaded recess 20 in the holder 14. In this state of assemblage, the booster sleeve 9 extends down to the charge 31 of the second booster 27, as illustrated in FIG. 4. In this way, the first and the second booster charges 5 and 31 together form an explosive connection in series when the two booster charges are brought in a pre-determined mutual position.

Figure 3:
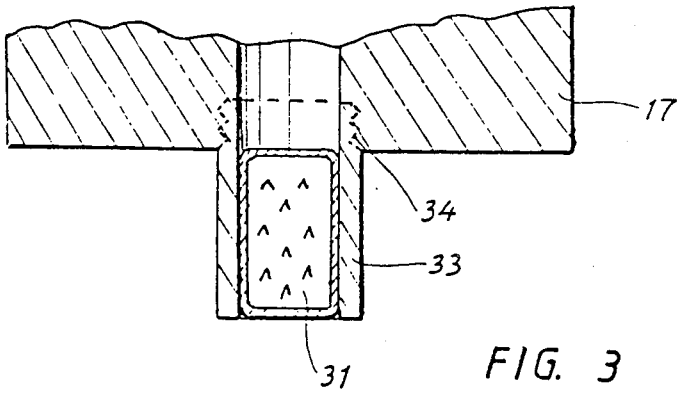

As illustrated in FIG. 3, the booster charge 31 may be alternatively accommodated in either a tubular extension 33 of the cylinder 17, or in an extension sleeve which is screwed to the cylinder 17 in the manner shown in broken lines 34 in FIG. 3.

The fuze 1 with the charge holder 14 screwed thereto, as illustrated in FIG. 4, can then be inserted into the recess 12 provided in the mine 13 (in the direction of the arrow 35 in FIG. 1) and screwed into the recess through the co-action of the screwthread 18 with the screwthread in the recess 12, therewith bringing the booster 27 into a booster position in the recess 15 provided in the mine 13.

Figure 5:
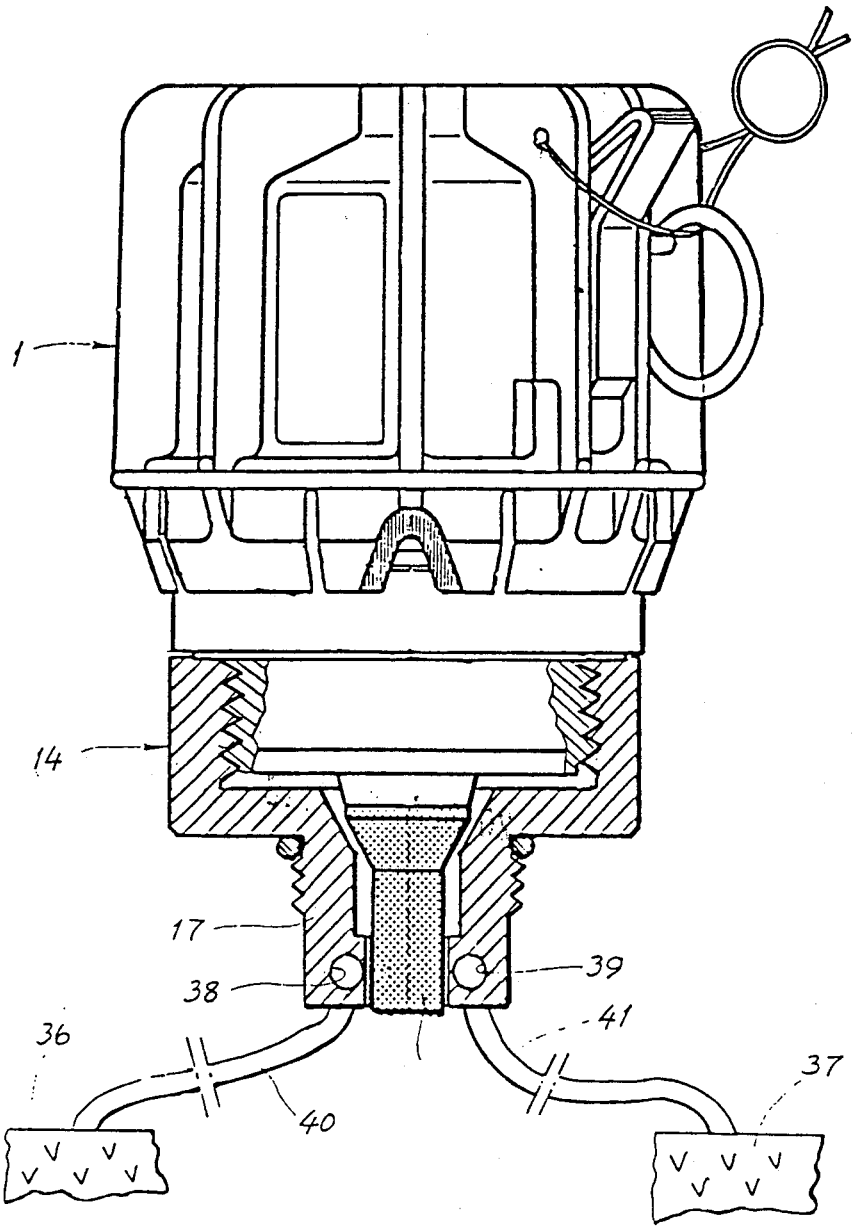
FIG. 5 is a side view, partly in central longitudinal section, of the mine fuze and the holder shown in FIG. 1, arranged for initiating the firing of remotely located explosive charges.

As schematically illustrated in FIG. 5, the holder 14 with the fuze 1 fitted thereto can also be used in accordance with the invention to initiate the firing of one or more remotely located explosive charges 36 and 37.

The cylinder 17 of the holder 14 is provided with one or more connecting means in the form of holes 38, 39 (shown only in FIG. 5 for simplicity of the drawings) which extend in the immediate vicinity of the booster sleeve 9 and through which initiating means in the shape of initiating cords 40, 41 are drawn to respective explosive charges 36 and 37. Consequently, if the assembly comprising the fuze 1 and the holder 14 is placed on or in the ground and is subsequently subjected to the load of an overpassing tracked or wheeled vehicle, the initiating cords 40 and 41 will be ignited by the booster charge 5 and in turn will fire the explosive charges 36 and 37.

In the FIG. 5 embodiment, the booster sleeve 27 incorporating the second booster charge 31 has been omitted, since the booster charge 5 alone is sufficient to ignite the initiating cords 40 and 41. No benefit is lost, however, when the booster sleeve 27 is also fitted to the holder 14.

The booster charges 5 and 31 may be of any known detonating type, and hence examples of their chemical compositions need not to be given here. Similarly, the initiating cords 40 and 41 may be of a known, e.g. detonating type, and consequently there is no need to describe their chemical composition in the present context.

Although in the illustrated embodiments the fuze 1 is secured to the holder 14 with the aid of screwthreads, and that screwthreads are also used as a means of securing the fuze/holder assembly to the mine, it will be understood that other connecting means, such as quick couplings, may be used in their stead.

Furthermore, although the booster charge of the illustrated embodiments is divided into two separate booster charge portions, namely a first portion connected to the fuze and a second portion carried by the holder, it will be understood that each of the individual booster portions may be divided into two or more part charges without departing from the scope of the present invention.

We claim:

1. A holder for a mine fuze for an antitank mine, in which the fuze incorporates a booster charge, a detonator for firing the booster charge, and a spring-biased firing pin for firing the detonator, characterized in that the holder is detachably conntectable to the mine fuze; and in that the holder with the fuze attached is intended to fit into a mine-fuze location provided in the antitank mine, in which location the booster charge is in detonating relationship with a high explosive charge contained by the mine, and the holder is also provided with connecting means for at least one initiating means for initiating the firing of one or more additional explosive charges which additional charges are located in the ground at a distance from the mine fuze, the booster charge being in fuzed relationship with the initiating means when the fuze and holder are attached, thereby enabling the mine fuze with the holder attached thereto to be primed selectively in the antitank mine in the fuze-location adapted for the holder, or to be primed in the ground as a booby trap for initiating firing of the additional explosive charges.

2. A holder according to claim 1, characterized in that it comprises a tubular member which encloses the booster charge of the mine fuze when the holder is connected to the mine fuze.

3. A holder according to claim 1, characterized in that it has the form of a connecting piece between the mine fuze and the mine fuze location in the antitank mine, to enable the mine fuze location to be attached when said location has a dimension different from that for which the mine fuze is intended.

* * * * *